United States Patent [19]

Satake et al.

[11] 4,208,274

[45] Jun. 17, 1980

[54] ROTARY CYLINDER TYPE GRAIN SEPARATOR

[75] Inventors: Toshihiko Satake, Higashihiroshima; Hiromichi Yanagihara, Hongomachi; Takashi Horie, Higashihiroshima, all of Japan

[73] Assignee: Satake Engineering Co., Ltd., Tokyo, Japan

[21] Appl. No.: 877,086

[22] Filed: Feb. 13, 1978

[30] Foreign Application Priority Data

Feb. 21, 1977 [JP] Japan ..... 52-18396

[51] Int. Cl.[2] ..... B07C 9/00

[52] U.S. Cl. ..... 209/44.2; 209/616

[58] Field of Search ..... 209/75, 76, 78, 44.2, 209/615, 616; 222/413

[56] References Cited

U.S. PATENT DOCUMENTS

| | | | |
|---|---|---|---|
| 1,384,494 | 7/1921 | Stone | 209/78 |
| 1,743,240 | 1/1930 | Ryder | 209/78 |
| 1,788,230 | 1/1931 | Bost | 209/78 |
| 2,601,608 | 6/1952 | Hansen | 222/413 |
| 3,200,945 | 8/1965 | Cota | 209/78 |
| 3,769,660 | 11/1973 | Schuette | 209/78 X |
| 4,018,675 | 4/1977 | Petrucci | 209/44.2 |

*Primary Examiner*—Joseph J. Rolla
*Attorney, Agent, or Firm*—Norbert P. Holler

[57] ABSTRACT

A rotary cylinder type separator comprises a slightly tiltable, horizontally installed rotary cylinder, a plurality of combs secured to the inside of the cylinder, in parallel and substantially axially of the cylinder, a feeder for introducing a mixture of grainy material and impurities into the cylinder at one end, an outlet formed at the other end of the cylinder for discharging the grainy material out of the cylinder, and a device for discharging the impurities larger in size than the grainy material and that have been scooped by the combs to a high level and have then fallen within the cylinder. The last-mentioned device is a fan for producing an air blast within the cylinder, or a combination of a stationary collection trough inserted axially through the cylinder for receiving the impurities that fall from the high level, and a screw conveyor mounted inside the trough.

1 Claim, 3 Drawing Figures

ROTARY CYLINDER TYPE GRAIN SEPARATOR

This invention relates to a rotary cylinder type separator for grainy material, especially cereal grain.

As a typical grain separator of the rotary cylinder type, a rice separator of the following construction is known in the art. The separator comprises a horizontal rotating cylinder formed with numerous semispherical dents in the inner wall and a collection though supported by stationary frames of the separator and extended axially of the interior of the cylinder. When separating rice, for example, the cylinder rotates with the rice fed in, so that individual normal grains too long for the dents slip off while shorter grains, such as broken rice, are carried upward by the dented surface to a sufficient height from which they can fall into the collection trough. Thus, according to the height from which they drop, the long grains of rice are separated from the short ones and both are taken out through separate outlets.

However, no rotary cylinder type separator has yet been developed which can efficiently remove impurities larger than the cereal grain being handled, for example, bits of cords, broken stems, chaff, and other long fragments, from the cereal.

The object of the invention is to provide a rotary cylinder type separator capable of efficiently removing the above-mentioned impurities from grainy material, especially from cereal grain.

According to this invention, a rotary cylinder type separator comprising a slightly tiltable, horizontally installed rotary cylinder, a plurality of combs secured to the inside of the cylinder, in parallel and substantially axially of said cylinder, feeder means for introducing a mixture of grainy material and impurities into said cylinder at one end, an outlet formed at the opposite end of said cylinder for discharging the grainy material out of said cylinder, and means for discharging the impurities larger in size than the grainy material and that have been scooped by said combs to a high level and have thence fallen within said cylinder is provided.

Also, according to the invention, a separator of the construction just set forth above is provided, in which said impurity discharge means comprises fan means for producing a blast of air within said cylinder.

Further, in accordance with the invention, a separator of the construction above set forth is provided, in which said impurity discharge means comprises a stationary collection trough inserted axially through said cylinder for receiving the impurities that fall from the high level, and a screw conveyor mounted inside said collection trough.

Figure 1:
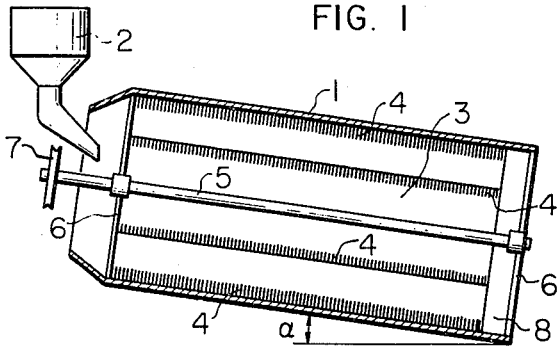
FIG. 1 is a partly sectional side view of a rotary cylinder of the invention for explaining essential constructional features thereof.

Referring to FIG. 1, there is shown a rotatably installed cylinder 1, which is associated with a hopper 2 for feeding a grainy material containing impurities to one end of the hollow 3 of the cylinder. On the inside of the cylinder 1, a plurality of combs 4 are set equidistantly and longitudinally or in the direction the material passes, with their teeth directed concentrically inward. In the figure, 5 is a rotating shaft, 6 is a spider for connecting the cylinder to the rotating shaft 5, 7 is a pulley for driving the shaft 5, and 8 is an outlet. In order to facilitate the passage of the grainy material, the cylinder 1 may be held as inclined at an adequate angle $\alpha$.

As the unclean grainy material is introduced into the hollow 3 of the rotating cylinder 1 from the hopper 2 at one end, the foreign matter is separated from the grainy material by the action of the combs 4 as will be explained later, and are forced out of the cylinder by impurity discharging means to be described later. The grainy material, freed of the impurities, is discharged at the outlet 8.

Figure 2:
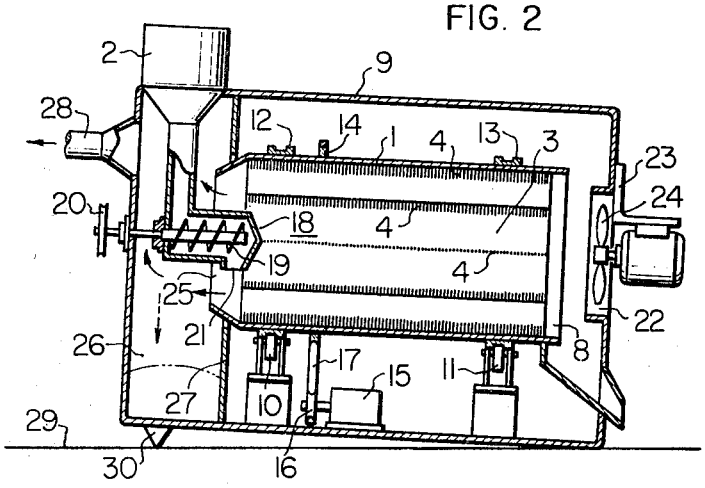
FIG. 2 is a partly sectional side view of an embodiment of the invention.

FIG. 2 shows the cylinder 1 mounted in a housing 9 and rotatably supported by two pairs of rollers 10, 11 installed on the bottom of the housing and engaged with annular rails 12, 13 correspondingly surrounding the cylinder. A pulley 14 is also provided on the outside of the cylinder 1 and is connected by an endless belt 17 to a pulley 16 of a motor 15 installed on the bottom of the housing. The hopper 2, secured to the upper part of the housing 9, communicates with a screw conveyor unit 18 mounted below the hopper. The unit comprises a screw conveyor 19, a drive pulley 20, and a material feed port 21. The end of the housing 9 opposed to the outlet 8 of the cylinder 1 is formed with an opening 22, in which a fan 24 is supported by a bracket 23, in alignment with the axis of the cylinder. An outlet 25 for discharging the impurities is formed at the end of the cylinder 1 opposite to the end having the outlet 8 for the cleaned grainy material. A chamber 26 for collecting the impurities is defined in the housing 9 by a partition wall 27, and includes an air outlet 28. In this embodiment the housing 9 is placed on the floor 29 with a slight inclination to the horizontal provided by means of a leg 30.

The operation of the apparatus will now be explained. The motor 15 is switched on to rotate the cylinder 1, the screw conveyor unit is driven, and unclean cereal grain or a mixture of the grain and impurities is fed to the bottom of the rotating cylinder 1 at the feed port 21. With the rotation of the cylinder, the combs 4 set longitudinally in spaced relation on the inside of the cylinder, with their rows of teeth directed concentrically inward, scoop the mixture in succession. From each ascending comb 4 the grain alone falls back by gravity through the gaps between the teeth toward the bottom of the cylinder. Chaff, broken stems, long fibers, and other impurities larger than the grain are carried upward, away from the grain, by the comb. In this way the grain and impurities are separated with a high degree of accuracy. As the cylinder continues to rotate and each comb carrying the impurities ascends higher, the teeth of the comb gradually turn downward, allowing the impurities to fall freely inside the hollow 3 of the cylinder. The extraneous matter thus released successively from the combs is forced back to the feed side of the cylinder 1 and is discharged through the outlet 25 by a blast of air being produced by the fan 24. The air then flows zigzag upward within the chamber 26 inside the housing 9 and leaves the apparatus at the outlet 28 formed in the upper part of the end wall. The foreign matter, on the other hand, falls gravitationally out of the air stream and settles on the bottom of the impurity collection chamber 26 as indicated by the alternate long and two short dashes line, to be suitably discharged afterward.

As the cylinder 1 rotates further, the grain is gradually separated from the impurities and moved axially of the cylinder until the grain alone is discharged from the cylinder at the outlet 8.

Although FIGS. 1 and 2 show the cylinder 1 or the housing accommodating the cylinder inclined at a slight angle to the horizontal, the inclination is not essential; the cylinder may be held on the level instead. In the latter case, the material to be separated is scattered axially of the cylinder by the combs on the ascending side of the bottom of the rotating cylinder and the grain is gradually separated from the impurities and delivered out of the cylinder. Nevertheless, the slight inclination of the cylinder as in the embodiments above described is desirable since it facilitates the passage of the grainy material through the cylinder and improves the operating efficiency. To accelerate the axial movement of material through the cylinder, the combs may be spiralled, rather than being straight, on the inside of the cylinder, or guide plates may be attached to the inside. These means may be further combined with the inclination of the apparatus for greater efficiency. The pitch of teeth of the combs may be suitably chosen by experiments according to the size and shape of the particles to be handled.

In the embodiment of FIG. 2, as stated, the blast of air produced by the fan 24 is used to discharge the impurities, scooped by the combs and released in the hollow 3, out of the cylinder. The air blast may be replaced by a mechanical arrangement as embodied in FIG. 3.

Figure 3:
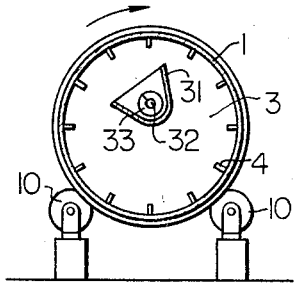
FIG. 3 is a partly sectional front view of another embodiment of the invention.

The embodiment of FIG. 3 includes a collection trough 31 supported by stationary brackets (not shown) of the selecting apparatus and extending axially inside the cylinder 1, substantially all along its length. Inside the trough is installed a screw conveyor 33 with a shaft 32 rotatably borne by stationary supports of the apparatus and extending in parallel with the trough.

In the same manner as in the preceding embodiments, with the rotation of the cylinder 1 in the direction indicated by an arrow, the foreign matter is scooped away from the grainy material by the combs, and slides off the combs from a high level in the hollow 3 of the cylinder. The falling impurities are received by the collection trough 31 and discharged out of the cylinder 1 by the screw conveyor 33.

The collection by the trough may be ensured by the provision of means for adjusting the angular position of the trough, so that the trough can be tilted to some degree about the axis of the shaft 32, on the mounting parts of the above-mentioned stationary supports for the trough.

With the construction described above, the present invention offers an advantage of great efficiency in removing bits of cords, broken stems, chaff, and other impurities from objective grains.

Although the invention has been described as related to the embodiments for separating and cleaning cereal grains, it is to be understood that the invention is also applicable to the separation of other grainy materials including earth and sand, and plastics without departing from the spirit of the invention.

Accordingly, various modifications in structure and/or function may be made by one skilled in the art to the disclosed embodiments without departing from the scope of the invention as defined by the claims.

What is claimed is:

1. A rotary cylinder type separator comprising a housing, a slightly tiltable horizontally extending rotary cylinder installed within and surrounded by the housing, the cylinder having first and second ends and a plurality of combs secured to the inside thereof in parallel relation to each other and substantially axially of the cylinder, means for rotating said cylinder, feeder means for introducing a mixture of grainy material and impurities into the cylinder at the first end of the cylinder, the feeder means being located in the housing at the first end of the cylinder and comprising a hopper and a screw conveyor connected to the hopper, an outlet formed in the housing at the second end of the cylinder for discharging from the cylinder and housing substantially only the grainy material, means arranged in the housing for discharging from the cylinder the impurities larger in size than the grainy material that have been scooped by the combs to a high level and have fallen within the cylinder, the impurity discharging means including fan means located at the second end of the cylinder for blowing air thereinto and exhaust means formed in the housing at the first end of the cylinder for exhausting air from the cylinder, whereby the impurities are discharged from the first end of the cylinder, and means formed within the housing for collecting the discharged impurities, the collecting means being a chamber formed by a partition, and the chamber being in air flow communication with the exhaust means.

* * * * *